US008847826B2

(12) United States Patent
Rao et al.

(10) Patent No.: US 8,847,826 B2
(45) Date of Patent: Sep. 30, 2014

(54) GRID NODE

(75) Inventors: Ramdas Rao, Brighton, MA (US); Erik Merck, Sharon, MA (US); Michael Quarella, Fitchburg, MA (US); Aron Viner, Ashland, MA (US)

(73) Assignee: Ambient Corporation, Newton, MA (US)

( * ) Notice: Subject to any disclaimer, the term of this patent is extended or adjusted under 35 U.S.C. 154(b) by 631 days.

(21) Appl. No.: 12/728,684

(22) Filed: Mar. 22, 2010

(65) Prior Publication Data

US 2011/0227797 A1 Sep. 22, 2011

(51) Int. Cl.

| | |
|---|---|
| ***H01Q 1/24*** | (2006.01) |
| ***H01Q 1/38*** | (2006.01) |
| ***H01Q 9/42*** | (2006.01) |
| ***H01Q 21/28*** | (2006.01) |
| ***H01Q 9/30*** | (2006.01) |

(52) U.S. Cl.

CPC . *H01Q 1/38* (2013.01); *H01Q 9/42* (2013.01); *H01Q 21/28* (2013.01); *H01Q 9/30* (2013.01)

USPC ..... 343/702; 343/873; 455/575.5

(58) Field of Classification Search

CPC ..... H01Q 1/38; H01Q 1/21; H01Q 1/28; H01Q 9/30; H01Q 9/42

USPC ..... 343/702, 873; 455/575, 90, 575.5

See application file for complete search history.

(56) References Cited

U.S. PATENT DOCUMENTS

| | | | | |
|---|---|---|---|---|
| 6,052,567 | A * | 4/2000 | Ito et al. | 455/575.7 |
| 7,026,813 | B2 * | 4/2006 | Homan et al. | 324/247 |
| 7,366,553 | B1 * | 4/2008 | Shields et al. | 455/575.1 |
| 7,486,243 | B2 * | 2/2009 | Wulff et al. | 343/702 |
| 2001/0024165 | A1 | 9/2001 | Steen, III et al. | |
| 2001/0055948 | A1 * | 12/2001 | Ikeda et al. | 455/13.3 |
| 2005/0083064 | A1 | 4/2005 | Homan et al. | |

FOREIGN PATENT DOCUMENTS

WO WO 2008/044012 4/2008

OTHER PUBLICATIONS

International Search Report for corresponding to International Patent Application No. PCT/US2010/047948 dated Nov. 29, 2010.
International Preliminary Report on Patentability dated Jun. 12, 2012 corresponding to patent application No. PCT/US10/47948.

* cited by examiner

*Primary Examiner* — Tho G Phan
(74) *Attorney, Agent, or Firm* — Ohlandt Greeley Ruggiero & Perle L.L.P.

(57) ABSTRACT

There is provided a grid node that includes (a) an outer shell made of a non-metal material, (b) an inner shell disposed in the outer shell, and defining a space therebetween, (c) a motherboard in the inner shell, and (d) a multiprotocol antenna array having a connector in communication with the motherboard, where the multiprotocol antenna array is disposed within the space.

25 Claims, 8 Drawing Sheets

GRID NODE

BACKGROUND OF THE INVENTION

1. Field of the Invention

The present disclosure relates to system elements for the remote monitoring of an electrical grid. Particularly, the present disclosure relates to utility equipment for connection to an element, such as, for example, a transformer, of a system for remote monitoring of an electrical grid that allows a utility company to have real-time visibility into its electrical grid, and a wireless high-speed data communications network using a variety of desired protocols, without the change of the utility equipment.

2. Description of the Related Art

Systems for monitoring electrical utility equipment are typically required to conform to certain mechanical and electrical requirements. Thus, the systems in the background art are built to support particular protocols and standards within the mechanical and electrical requirements.

A system according to the background art may provide an antenna to transmit or receive data about an operation of the system. However, an antenna-equipped system that must be maintained outdoors, as electrical utility equipment-monitoring systems, has the antenna exposed to outside elements, while the remainder of the system is enclosed in a housing that protects the system from weather, contamination, and external interference. Housings of the background art need to provide adequate protection for the system, but must also permit useful functioning of the antennas.

There exists a need for a system that overcomes the design difficulties of prior art systems.

SUMMARY OF THE INVENTION

There is provided a grid node having an enclosed antenna system that operates at least as effectively as prior art external antenna systems.

There is also provided a grid node having an enclosed antenna system that has a multiprotocol antenna array. The multiprotocol antenna array enables the node to support any one of the multiple protocols without the grid node being removed from the grid node site.

There is further provided a grid node that has a hollow outer shell, an inner shell disposed in the outer shell that forms a ground plane, a motherboard that is disposed in the inner shell; and a multiprotocol antenna array having a connector in communication with the motherboard. The multiprotocol antenna array is sized to be disposed in a space defined by the inner shell and outer shell.

There is yet further provided a grid node that has a hollow outer shell made of a non-metal material, an inner shell disposed in the outer, and a multiprotocol antenna array sized to be disposed in a space defined by the inner shell and outer shell in which the outer shell does not affect the functioning of the antenna array.

There is still further provided a method of constructing a grid node comprising the steps of: providing an inner shell that receives a motherboard having a processor, a memory, and a storage, wherein the inner shell is opaque to RF frequencies and forms a ground plane; providing an outer shell that is adapted to receive the inner shell and having an interior space therebetween; placing an antenna array in the interior space and in communication with the motherboard, wherein the antenna array is not disposed within the ground plane.

BRIEF DESCRIPTION OF THE DRAWINGS

A more complete understanding of the present disclosure may be had by reference to the several drawing figures, in which.

DESCRIPTION OF THE INVENTION

Figure 1:
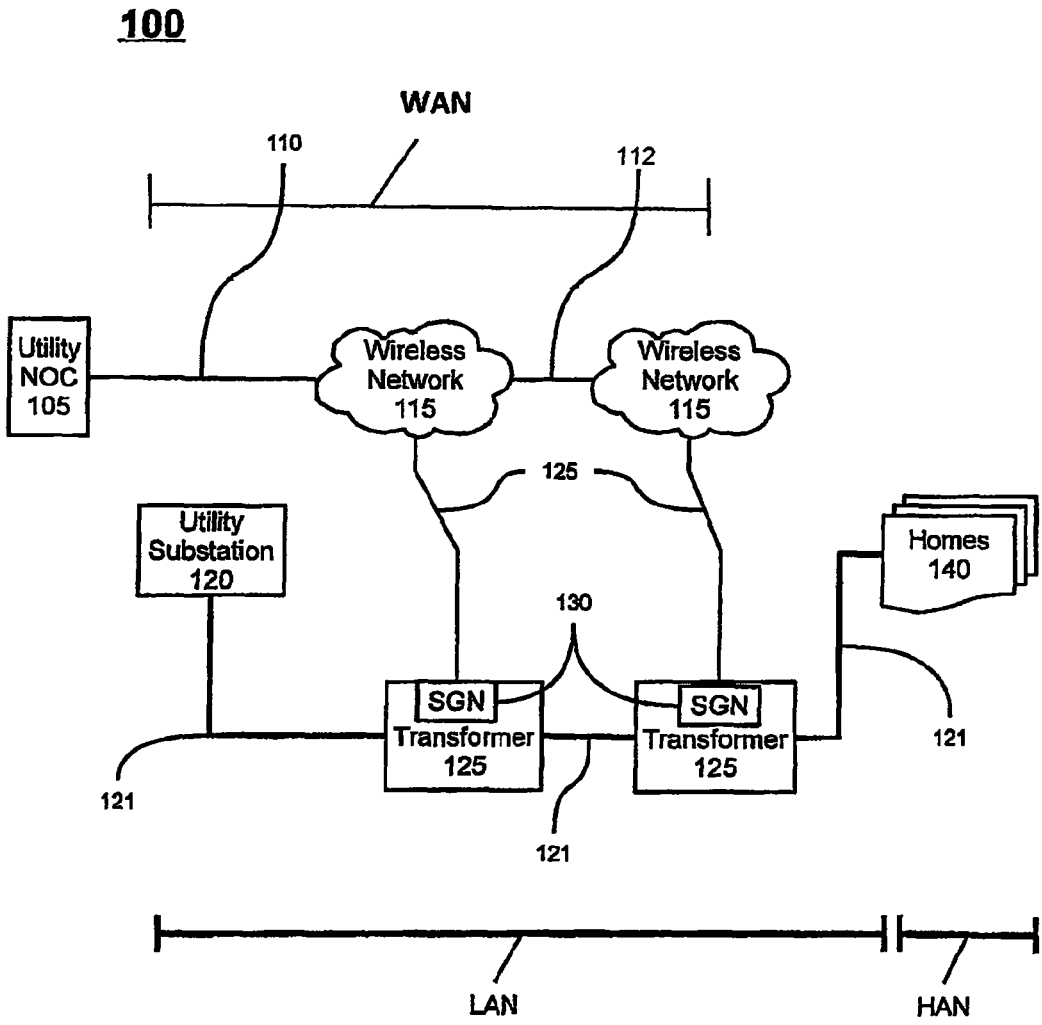
FIG. 1 shows a power grid system.

Referring to the drawings, and, in particular FIG. 1, there is shown a power grid system generally presented by reference numeral 100. Power grid system 100 is a main way for transmitting energy in the form of electricity from a site of generation (not shown) through a utility substation 120 and on to end users. Power is transmitted by an electrical utility company from utility substation 120 by way of power lines 121, which are suitable for carrying medium voltage and low voltage alternating current (AC) power. However, a voltage or a current of the AC power must be modulated between utility substation 120 and homes 140. This is achieved by using a number of medium and low voltage transformers 125. Ordinarily, transformers 125 can be situated in an outdoor operating environment at various locations on grid system 100.

As used herein, the term "medium voltage" means between about 2 and about 35 kilovolts (kV). As used herein, the term "low voltage" means up to about 0.6 kV. The term "about" means plus or minus 5% of the stated value.

Equipment that is designed for use with power lines 121 and transformers 125 must accommodate whatever operating environment is provided by power lines 121 and transformers 125 themselves. As used herein, "operating environment" includes parameters such as temperature, moisture, electrical pulses, noise, vibration, and the like.

Ordinarily the electric power utility company maintains a remote facility for monitoring its operations. Such a facility is referred to as a Network Operations Center (NOC) 105. Since it is useful for the electric utility company to monitor its transmission lines 121 and transformers 125 from NOC 105, power grid system 100 provides grid nodes (SGN) 130 that are installed with transformers 125. In an embodiment, SGN 130 are installed via mounting bracket means (not shown) to transformers 125. SGN 130 is in communication over network link 125 with a wireless network 115. In an embodiment, network link 125 supports any one or more suitable wireless protocols.

The suitable wireless protocols include CDMA/GPRS (800-950 and 1850-2000 MHz), LTE (700-800 MHz), GPS/cellular (1570-1580 MHz), RF Badger/Itron (900-960 MHz), IEEE 802.11a/b/g/n (2400-2500 and 4900-5900 MHz), and IEEE 802.15.4.

Several wireless networks 115 are netted together by way of a WAN link 112. In an exemplary embodiment, WAN link 112 is an Internet Protocol (IP) network. Ultimately, NOC 105 interfaces with wireless network 115 using back-office interface 110. Back-office interface 110 is any suitable interface to a wireless network, including cellular network, wired or wireless Ethernet networks, and the like. In the network architecture shown in FIG. 1, SGN 130 is positioned to provide data entry points on transformers. However, SGN 130 can be installed essentially anywhere on the electrical grid.

Utility substation 120, transformers 125, and SGNs 130 together comprise a local area network (LAN). End-user installations, shown in FIG. 1 as homes 140, together form a home area network (HAN). The utility NOC 105 and the wireless network 115 comprise the WAN.

Figure 2:
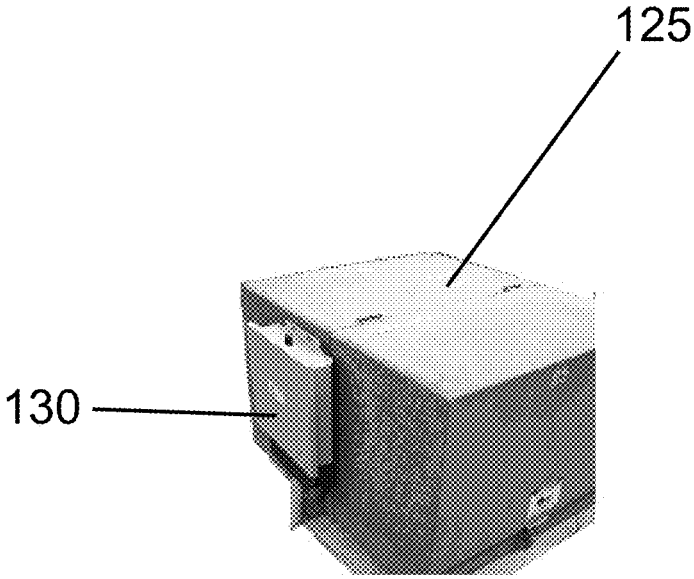
FIG. 2 shows a grid node mounted on a transformer.

Referring to FIG. 2, there is shown a typical installation of a SGN 130 that is mounted to a transformer 125. As shown, transformer 125 is a pad mount-type transformer. In an embodiment, transformer 125 is a telephone pole mounted type transformer, SGN 130 is mounted to a pole near transformer 125 or other utility equipment, such as relays, switches, sensors, and the like, by a bracket 139 (FIG. 3).

In an embodiment, SGN 130 has dimensions of 34 cm×29 cm×13.7 cm.

Figure 3:
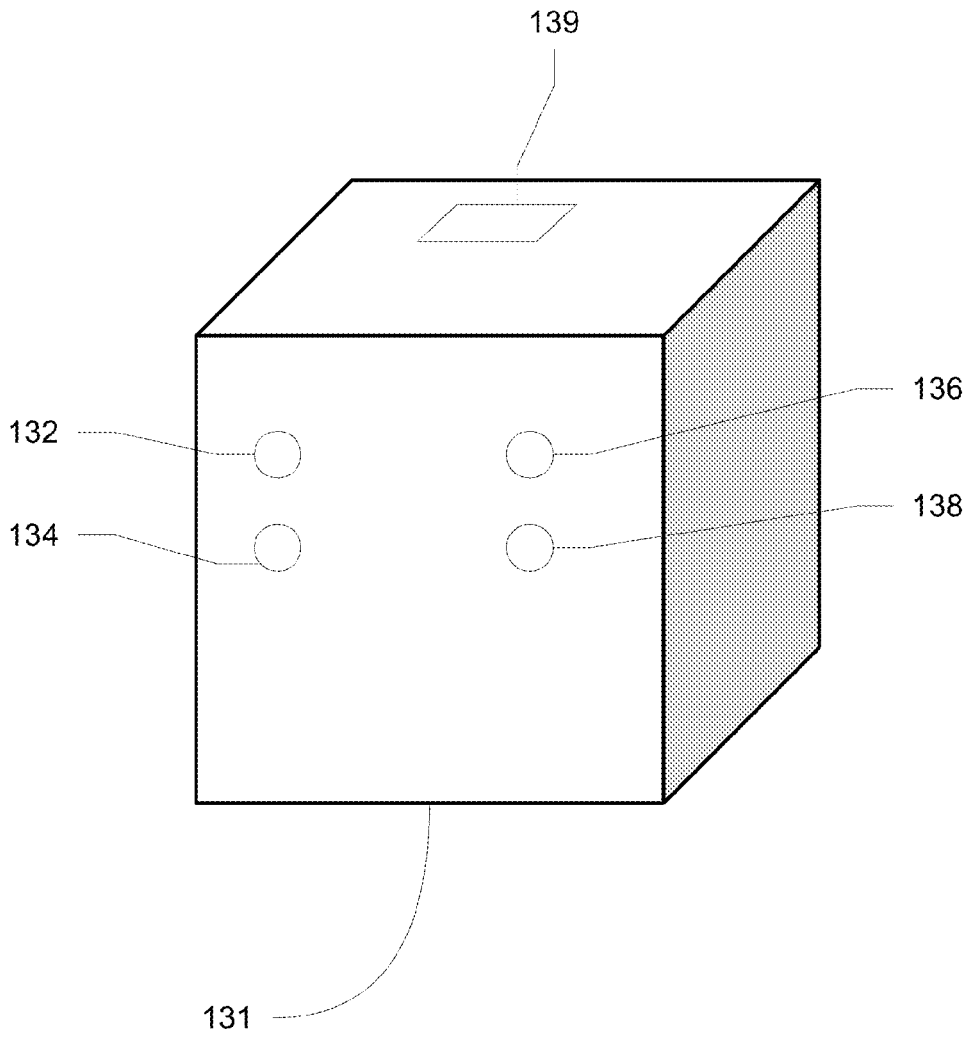
FIG. 3 shows an outer shell of a grid node of the present disclosure.

Referring to FIG. 3, SGN 130 has an outer shell 131. In a preferred embodiment, outer shell 131 is manufactured from fiberglass. In another embodiment, outer shell 131 is manufactured from injection molded plastic. Outer shell 131 could be manufactured from any material that is both capable of withstanding environmental conditions likely to prevail around SGN 130, and yet also that is not opaque (that is, outer shell 131 is transparent) to any wireless protocol and signal described herein. Thus, it is believed that outer shell 131 could be manufactured of any non-metal material that is both capable of withstanding environmental conditions and is not opaque (that is transparent) to any wireless protocol and signal described herein.

SGN 130 may have a mount, such as a bracket 139, on an external face of outer shell 131. Bracket 139 can provide a stable connection to a pad type transformer (FIG. 2) or to a telephone pole mounted transformer (not shown).

SGN 130 provides external connections. Particularly, SGN 130 provides a power connector 132 that mates with a power supply that supplies 90-300 VAC/50-60 Hz electrical power to SGN 130. Further provided are an Ethernet RJ-45 connector 134 and an RS-232 console port 136. There is provided an optional connector 138 for a wi-fi antenna or for energy sensing equipment (not shown).

Energy sensing equipment is an input to SGN 130 that outputs a stream of data concerning an operational state of transformer 125 to SGN 130. In turn, such data are processed internally and/or communicated over wireless network 115, optionally via a wired network segment such as power lines 121, and ultimately to NOC 105.

Figure 4:
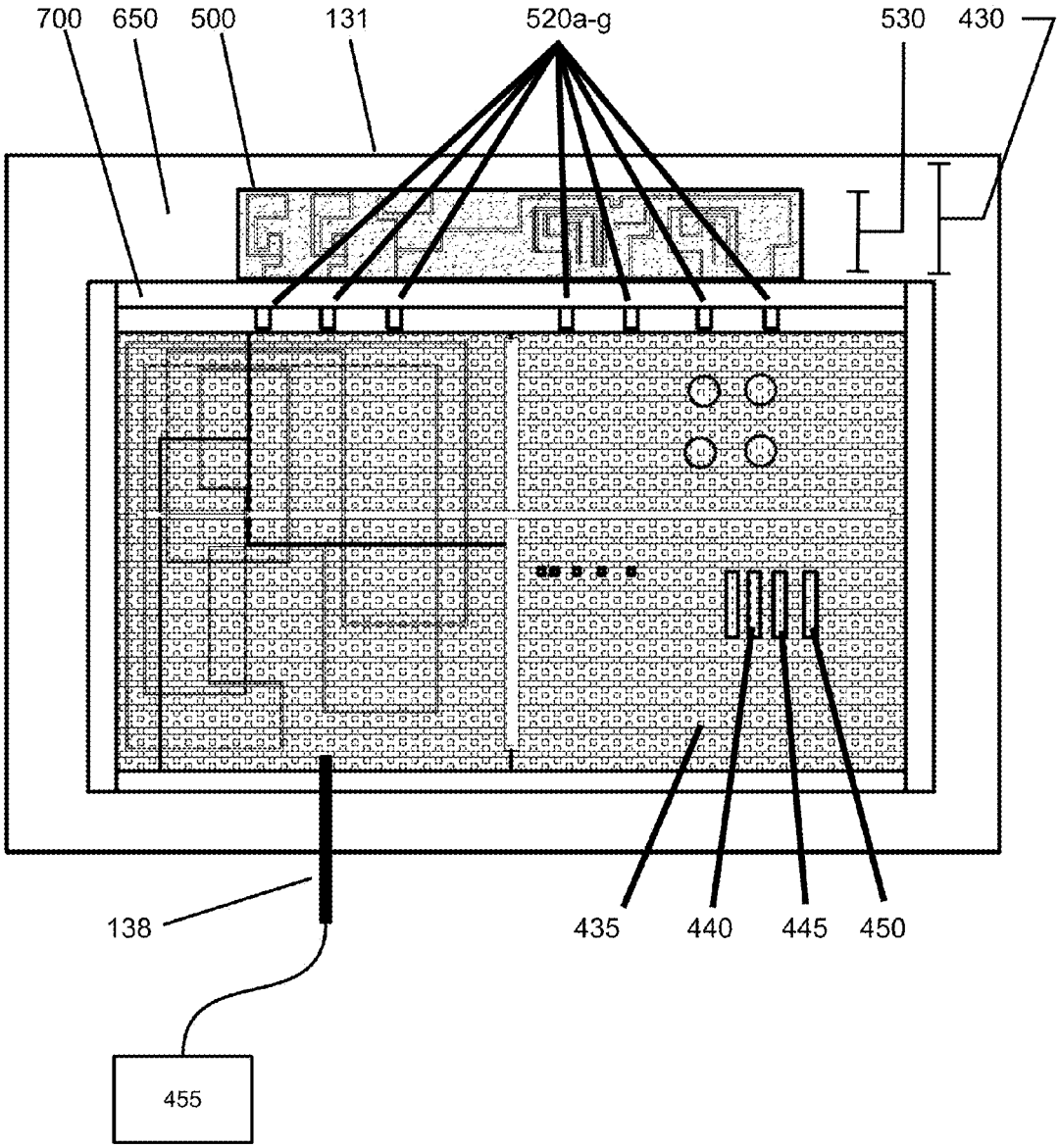
FIG. 4 shows a top view of the grid node of FIG. 3.

Referring to FIG. 4, SGN 130 has outer shell 131 and inner shell 700. During operation of SGN 130, cover member 730 (shown in FIG. 7) covers inner shell 700 thereby substantially enclosing, and RF shielding, any components that are in inner shell 700 and thereby forming a ground plane. Internal components of SGN 130 in inner shell 700 are attached to or integrated into a motherboard 435 that is in turn installed in inner shell 700, thereby placing such components in communication with one another. Motherboard 435 has a socket for a central processor 440, a memory 445, and a storage medium 450. Storage medium 450 stores data, such as instructions for processor 440, in persistent and machine-readable form for loading into memory 445.

Outer shell 131 and inner shell 700 have a space 650 therebetween. An antenna array 500 is positioned in space 650. Antenna array 500 is connected, as discussed below, to components in inner shell 700.

Connectors 520*a-g* are connected to motherboard 435 to place structures 510*a-h* (FIG. 5) in communication with motherboard 435 and under control of processor 440. Processor 440 executes machine-readable persistent instructions from memory 445, which instructions cause a signal to be emitted from one or more of structures 510*a-h*, to be received from one or more of structures 510*a-h*, and to be analyzed by processor 440. Connector 138 is in communication with motherboard 435 and connects to power-monitoring equipment 455. Power-monitoring equipment 455 can receive an input signal from power grid infrastructures, such as transformers, switches, as well as metering devices such as water and gas meters, or indeed metrology devices generally. Processor 440 analyzes the input signal and may perform one or more additional steps of storing data for the signal, analyzing the data, and communicating the data to a receiver using any of the protocols described herein.

Figure 5:
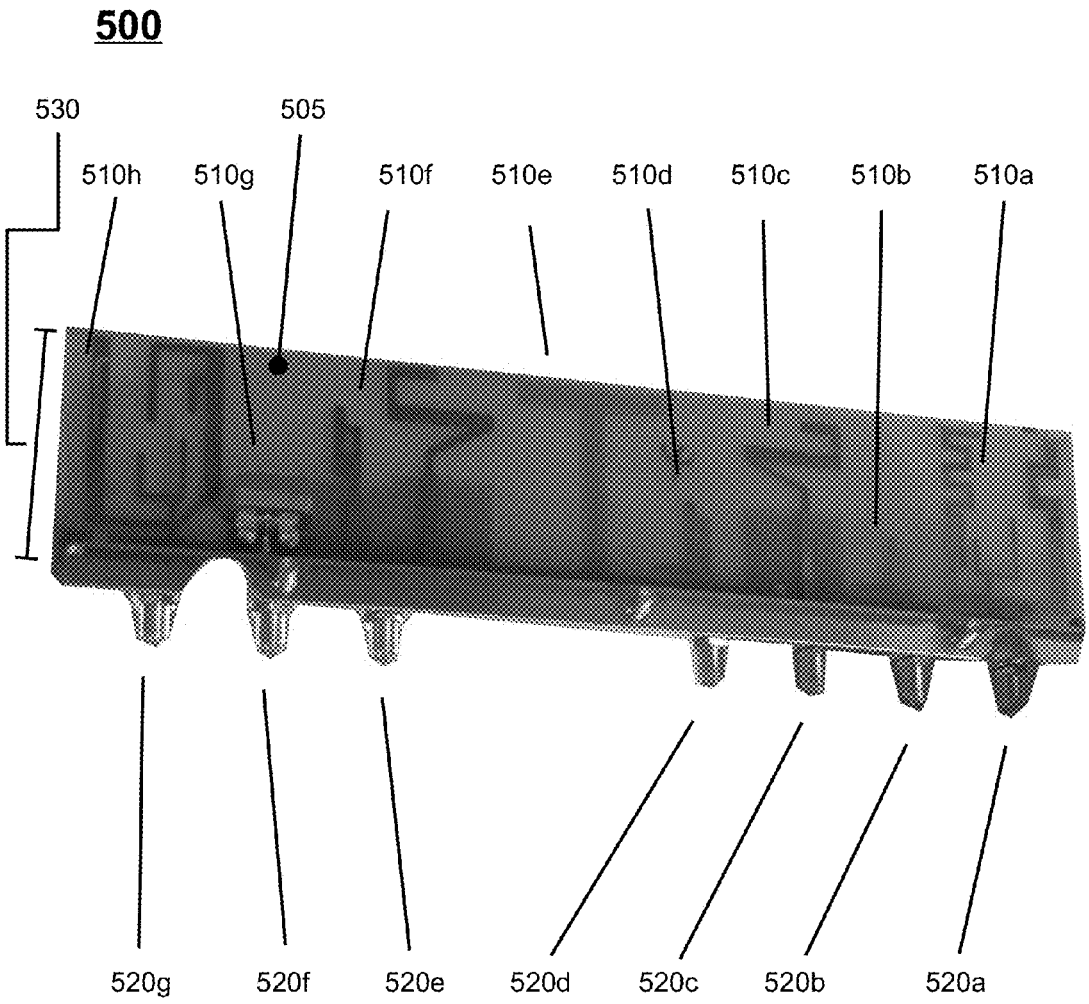
FIG. 5 shows a multiprotocol antenna array in the grid node of FIG. 3.

Referring to FIG. 5, a preferred antenna array 500 is shown in detail. Antenna array 500 is a multiprotocol integrated antenna array. Antenna array 500 comprises a supporting matrix 505 through which are disposed substantially coplanar structures 510*a-h* that can receive and emit electromagnetic (EM) radiation at particular frequency bands. Each structure 510*a-h* itself is an antenna for receiving/transmitting RF signals at a particular frequency band. In a preferred embodiment, the frequency bands are 700-800 MHz, 800-950 MHz, 1850-2000 MHz, 1570-1580 MHz, 900-960 MHz, 2400-2500 MHz and 4900-5900 MHz. Each of these frequency bands is a frequency band that is used by a particular wireless communication protocol. In the preferred embodiment, structures 510*a-h* act as omnidirectional antennas.

Supporting matrix 505 has a dimension 530 that is sized to fit in space 650 shown in FIG. 4 so that the upper end for dimension 530 is determined by the available space 650. That is, inner shell 700 is, for example, a box-shape that is smaller than outer shell 131 so that remaining space 650 dictates dimension 530 as shown more clearly in FIG. 4.

Since dimension 530 is a physical constraint, there is therefore a design difficulty to overcome in that an optimum size for each structure 510*a-h*, each of which is intended to receive a particular RF band, would be, if linearly arranged, substantially greater than dimension 530. A further design difficulty is an engineering specification that structures 510*a-h* have gain of greater than about 3 to greater than about 5 dBi. These design difficulties are overcome by making structures 510*a-h* nonlinear in shape and by changing inductance and/or capacitance of structures 510*a-h*. The size and shape of structures 510*c* and 510*f* make certain that these structures operate at the same frequency ranges. As shown, structure 510*c* and 510*f* appear as mirror images. The mirror images of structures 510*c* and 510*f* provide diversity, namely phase and 180 degrees out of phase signals of the same source signal. This diversity increases performance as discussed below.

RF signals that are received by structures 510*a-h* are, in turn, communicated to an apparatus (not shown) via connectors 520*a-g*. In the exemplary embodiment, connectors 520 are less numerous than structures 510, namely antenna structures, because of the requirement for diversity. As used herein, the term "diversity" or "antenna diversity" means the use of two or more antennas to sample the same signal to improve performance of the received signal. In the present grid node, two antennas sample the same signal at phase and 180 degrees out of phase.

Structures 510*a-h* are, further, designed to provide a RF isolation therebetween of at least 20 decibels (dB). As used herein, "RF isolation" between structures 510 (i.e., antennas)

means it is ensured that other frequencies transmitted and/or received by the node does not interfere with the particular module.

Figures 6A, 6B:
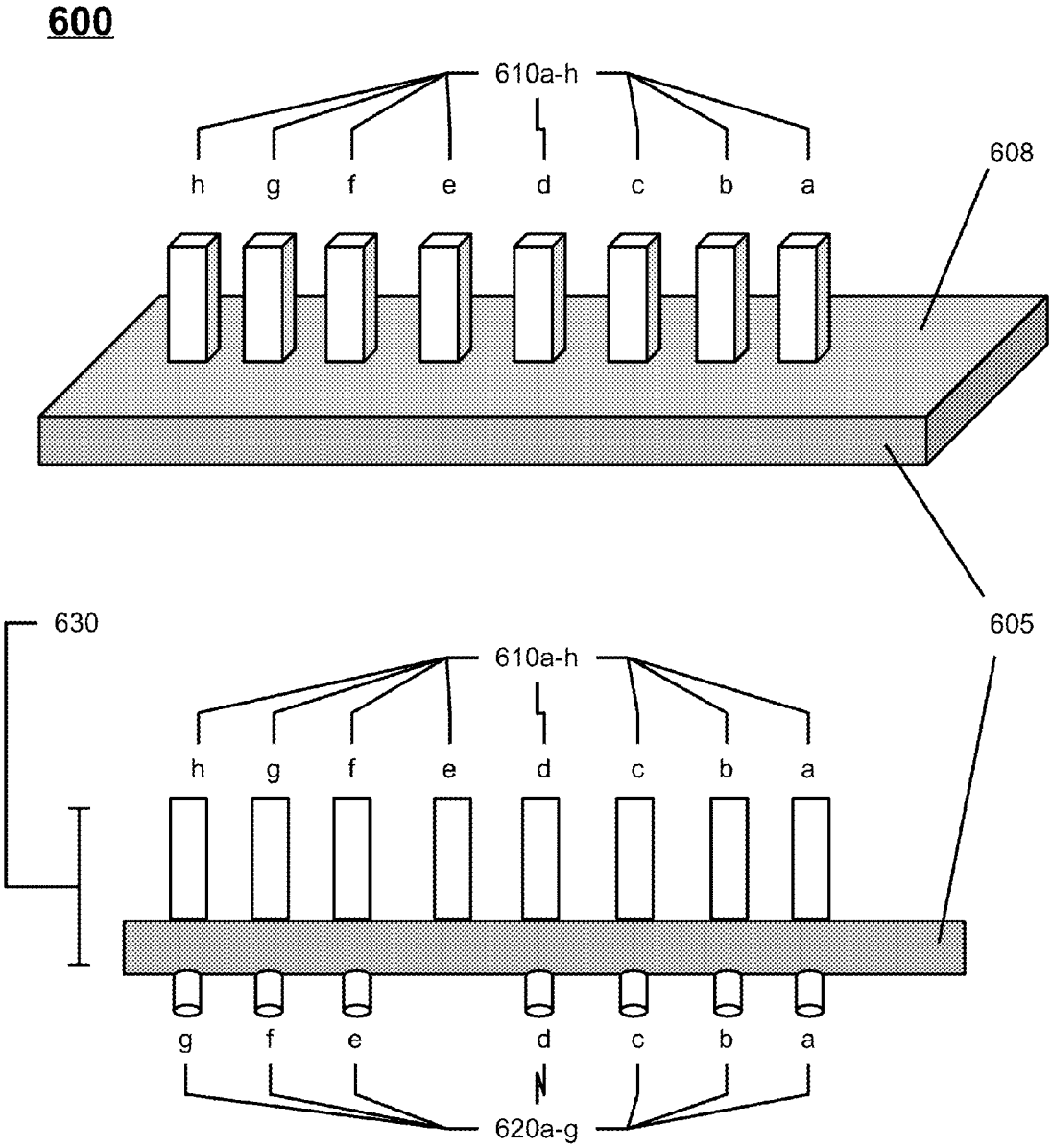
FIGS. 6A and 6B show an alternative multiprotocol antenna array for use in the present disclosure.

FIGS. 6A and 6B show another multiprotocol integrated antenna array 600. Antenna array 600 comprises a supporting matrix. Matrix 605 has a top surface 608. On surface 608, there is disposed substantially perpendicularly structures 610*a-h* that can receive and emit electromagnetic (EM) radiation at particular frequency bands. Each structure 610*a-h*, similar to each structure 510*a-h*, is itself an antenna for receiving/transmitting RF signals at the particular frequency bands. As in antenna array 500, in a preferred embodiment, the frequency bands for antenna array 600 are 800-950 MHz, 1850-2000 MHz, 1570-1580 MHz, 900-960 MHz, 2400-2500 MHz and 4900-5900 MHz. Each band is a frequency band that is used by a particular wireless communication protocol. In the preferred embodiment, structures 610*a-h* act as omnidirectional antennas. A supporting matrix 605 and structures 610*a-h* together have a dimension 630 to fit in space 650 (shown in FIG. 4).

An upper bound for dimension 630 is determined by an availability of space between outer shell 131 and inner shell 700, i.e., a ground plane. That is, inner shell 700 is, for instance, a box-shape that is somewhat smaller than outer shell 131, and a remaining available space dictates that dimension 630 be less than dimension 430 (FIG. 4).

As with antenna array 500, the dimension 630 is a physical constraint of SGN 130 in that an optimum size for each structure 610*a-h* would be, if linearly arranged, substantially greater than dimension 630. As with antenna array 500, structures 610*a-h* have gain of greater than about 3 to greater than about 5 dBi, and again is achieved by making structures 610*a-h* nonlinear in shape and by changing inductance and/or capacitance of structures 610*a-h*.

As with antenna array 500, RF signals that are received by structures 610*a-h* are, in turn, communicated to an apparatus (not shown) via connectors 620*a-g* at a lower face of supporting matrix 605. In the exemplary embodiment, connectors 620*a-g* are less numerous than structures 610 because of the requirement for diversity. Structures 610*a-h* are designed to provide an isolation therebetween of at least 20 decibels (dB).

With either antenna array 500 or antenna array 600, the present grid node can support any one of the multiple protocols without the grid node 130 being removed from the grid node site.

Figure 7:
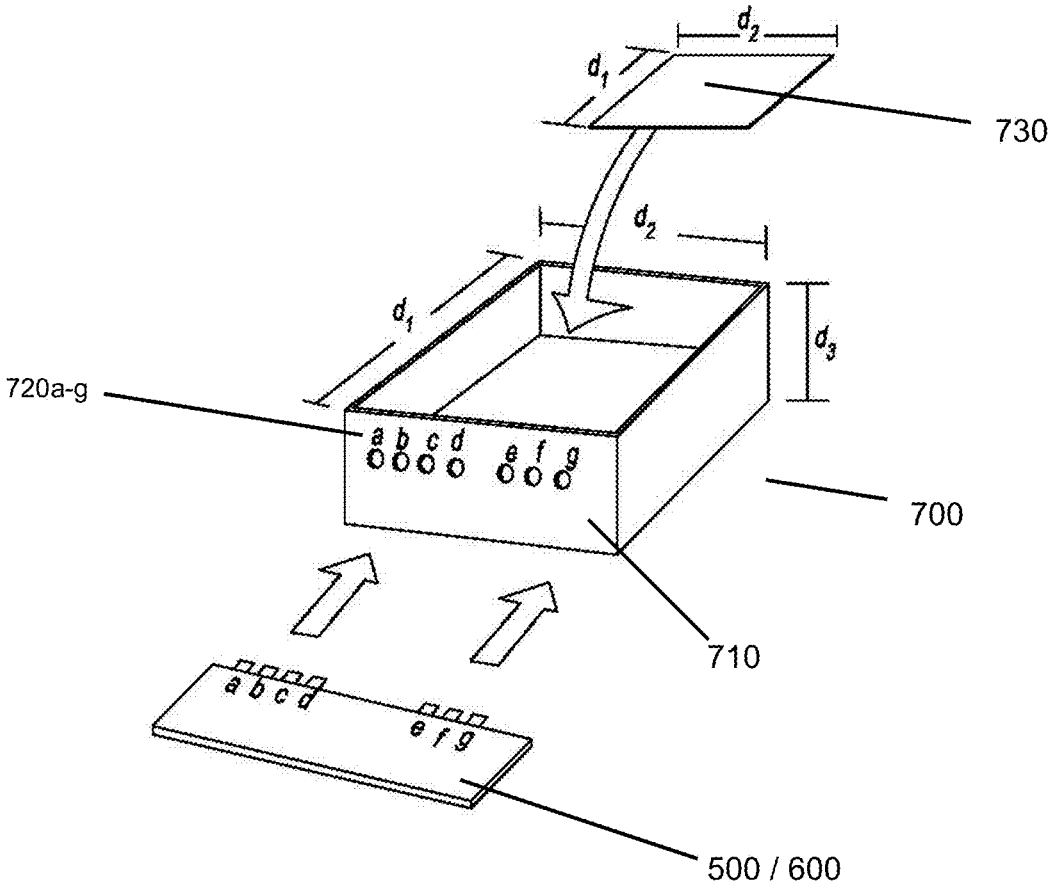
FIG. 7 shows a ground plane of the grid node of the present disclosure.

Referring to FIG. 7, inner shell 700 is sized to be enclosed by outer shell 131. Inner shell 700 is manufactured from a suitable conductive material, for example, steel, aluminum, copper, and is accordingly opaque to RF radiation. Inner shell 700 is sized to enclose SGN 130 internals, as shown in FIG. 4. In a first dimension d1, inner shell 700 is 9.1 inches. In a second dimension d2, inner shell 700 is 9.6 inches. In a third dimension d3, inner shell 700 is 4.2 inches. A generally planar cover member 730 having a rectangular shape of d1×d2 covers inner shell 700, thus enclosing within inner shell 700 a volume V of approximately d1×d2×d3 cubic inches.

A portal face 710 of inner shell 700 has a plurality of holes 720*a-g* disposed therethrough. In an embodiment, holes 720*a-g* are in a pattern that mates motherboard 435 with connectors a-g of a multiprotocol integrated antenna array 500 (FIG. 5) or 600 (FIGS. 6A and 6B) that has a dimension 530, 630, respectively, to be disposed within space 650 (FIG. 4).

This arrangement advantageously permits integrated antenna array 500 or antenna array 600 to be disposed outside of inner shell 700, and SGN 130 internals to be disposed in inner shell 700. Since inner shell 700 is itself conductive, SGN 130 internals will be shielded from external RF interference.

A further advantage of inner shell 700 is that SGN 130 internals disposed therein are tolerant of a design spec pulse voltage of 6 kV. As used herein, the term "pulse voltage" means a high energy pulse that is the result of a fault condition or a lightning strike.

Figure 8:
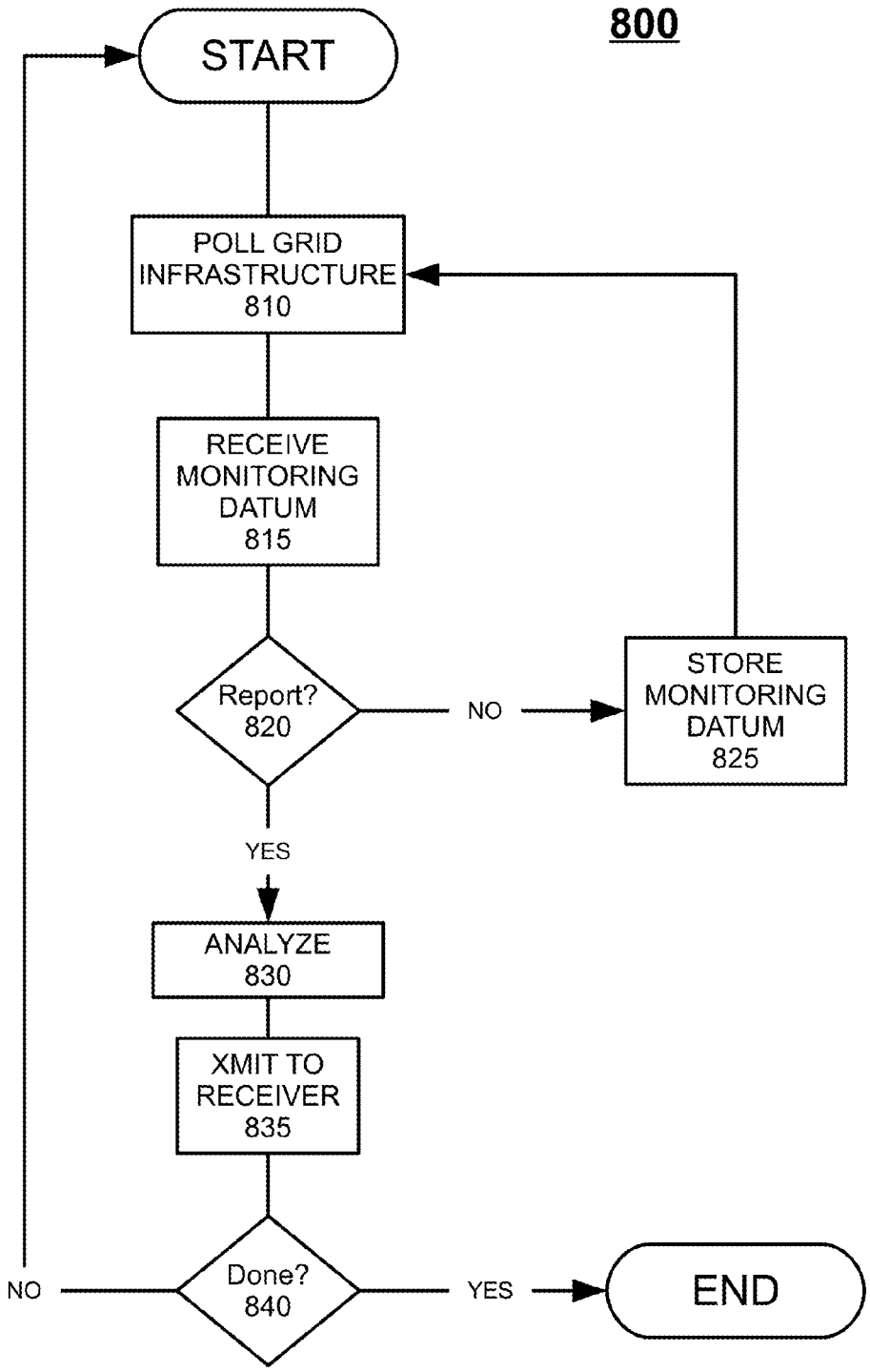
FIG. 8 is a method for reporting an operating parameter of a piece of power grid infrastructure.

FIG. 8 is a process flow diagram of a method 800 for reporting an operating parameter of a piece of power grid infrastructure, which is, by way of nonlimiting example, transformer 125. Method 800 begins with step 810.

At step 810, SGN 130 polls a piece of power grid infrastructure. In an embodiment, this step of polling is via power monitoring equipment 455, although it is also within the contemplation of the present disclosure that SGN 130 could cause another monitoring station or apparatus to poll. Next, method 800 proceeds to step 815.

At step 815, SGN 130 receives a monitoring datum from the piece of power grid infrastructure, and method 800 proceeds to step 820. From step 820, if SGN 130 is configured to report immediately the monitoring datum, then method 800 will proceed to step 830. Otherwise, method 800 will proceed to step 825.

At step 825, the monitoring datum is stored by SGN 130. In a preferred embodiment, the monitoring datum is written to one or more of memory 445 and storage medium 450. Method 800 next returns to step 810 so that SGN 130 can poll more data from the piece of power grid infrastructure.

At step 830, SGN 130 prepares to transmit the polled datum (or data, if desired, from step 825) to a receiver. In step 830 SGN 130 performs an analysis to produce a result, which analysis could take many forms, for example: a sort; a binning; a timestamping; an averaging; a compression; a smoothing; an encryption; a digital signing; or any combination thereof. By way of this analysis, SGN 130 may raise an alarm condition. An alarm condition is that a partial discharge has occurred, or that a voltage or a current condition has surpassed a predesired, and probably configured, threshold. Further, performing this analysis makes it possible for SGN 130 to transmit a smaller dataset to NOC 105 for analysis, saving on NOC 105 computing resources and bandwidth. When this analysis is complete, method 800 next proceeds to step 835.

At step 835, results of the analysis of step 830 are transmitted to a receiver. This step of transmitting is by way of transmitting the results using one or more of the protocols described herein, via one or more of structures 510*a-h*, 610*a-h*, RJ-45 connector 134, and RS-232 console port 136. The receiver can be another SGN 130, a node that is on wireless network 115, utility substation 120, utility NOC 105, or even transformer 125 itself (for control). Optionally, SGN 130 if properly equipped for Global Positioning Satellite (GPS) reception will include in the data transmitted to the receiver a geographic position (lat/lon/elevation) of SGN 130.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated for carrying out this disclosure, but that this disclosure will include all embodiments falling within the scope thereof.

What is claimed is:

1. A grid node comprising:

an outer shell made substantially of a non-metal material;

an inner shell disposed in and enclosed by said outer shell, and defining a space therebetween;

a motherboard in said inner shell; and a multiprotocol antenna array having a connector in communication with said motherboard, wherein said multiprotocol antenna array is disposed within said space.

2. The grid node of claim 1, wherein said multiprotocol antenna array further comprises structures that receive and transmit RF signals, wherein said RF signals have a frequency selected from the group consisting of about 700-800 MHz; about 800-950 MHz; about 1850 to about 2000 MHz; about 1570 to about 1580 MHz; about 900 to about 960 MHz; about 2400 to about 2500 MHz; and about 4900 to about 5900 MHz.

3. The grid node of claim 2, wherein said non-metal material is transparent to said RF signals at said frequency.

4. The grid node of claim 2, wherein said non-metal material is selected from the group consisting of fiberglass and injection molded plastic.

5. The grid node of claim 2, wherein said inner shell is opaque to said RF signals at said frequency.

6. The grid node of claim 5, wherein said inner shell is a conductive material.

7. The grid node of claim 6, wherein said conductive material is selected from the group consisting of steel, aluminum, and copper.

8. The grid node of claim 2, wherein said multiprotocol antenna array further comprises a supporting matrix.

9. The grid node of claim 8, wherein said structures are substantially coplanar with said supporting matrix.

10. The grid node of claim 8, wherein said structures are substantially perpendicular to said supporting matrix.

11. The grid node of claim 1, wherein said motherboard further comprises a processor.

12. The grid node of claim 1, wherein said inner shell further comprises a cover member that substantially encloses and shields said motherboard from RF emissions.

13. The grid node of claim 1, wherein said motherboard is tolerant of a pulse voltage of 6 kilovolts.

14. The grid node of claim 1, wherein said structures of said multiprotocol antenna array, without removal of said grid node from a site of installation, receive and transmit RF signals having a frequency selected from the group consisting of about 700-800 MHz; about 800-950 MHz; about 1850 to about 2000 MHz; about 1570 to about 1580 MHz; about 900 to about 960 MHz; about 2400 to about 2500 MHz; and about 4900 to about 5900 MHz.

15. The grid node of claim 1, wherein said multiprotocol antenna array comprises:

a first antenna for transmitting and receiving signals in a first frequency band; and a second antenna for transmitting and receiving signals in a second frequency band.

16. The grid node of claim 15, wherein each of said first antenna and said second antenna is omnidirectional.

17. The grid node of claim 15, wherein said first antenna and said second antenna have at least 20 decibels of RF isolation therebetween.

18. A method of constructing a grid node, comprising:

providing an outer shell made substantially of a non-metal material;

disposing an inner shell made of a conductive material in and enclosed by said outer shell and forming a space therebetween;

positioning a motherboard having a processor and a memory in said inner shell; and positioning an antenna array in communication with said motherboard in said space.

19. The method of claim 18, wherein said antenna array is a multiprotocol integrated antenna array.

20. The method of claim 18, wherein said antenna array comprises:

a first antenna for transmitting and receiving signals in a first frequency band; and a second antenna for transmitting and receiving signals in a second frequency band.

21. The method of claim 20, wherein each of said first antenna and said second antenna is omnidirectional.

22. The method of claim 20, wherein said first antenna and said second antenna have at least 20 decibels of RF isolation therebetween.

23. A grid node comprising:

an outer shell made substantially of a non-metal material;

an inner shell disposed in and enclosed by said outer shell, and defining a space therebetween;

a motherboard in said inner shell;

a first antenna communicatively coupled to said mother board via a first connector, for transmitting and receiving signals in a first frequency band; and a second antenna communicatively coupled to said mother board via a second connector, for transmitting and receiving signals in a second frequency band, wherein said first antenna and said second antenna are disposed within said space.

24. The grid node of claim 23, wherein each of said first antenna and said second antenna is omnidirectional.

25. The grid node of claim 23, wherein said first antenna and said second antenna have at least 20 decibels of RF isolation therebetween.

* * * * *